US010107310B2

(12) United States Patent
Kondo et al.

(10) Patent No.: US 10,107,310 B2
(45) Date of Patent: Oct. 23, 2018

(54) HYDRAULIC DRIVE SYSTEM

(71) Applicant: KAWASAKI JUKOGYO KABUSHIKI KAISHA, Kobe-shi, Hyogo (JP)

(72) Inventors: Akihiro Kondo, Nishinomiya (JP); Takuya Fukumoto, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 289 days.

(21) Appl. No.: 14/917,682

(22) PCT Filed: Oct. 7, 2014

(86) PCT No.: PCT/JP2014/005091
§ 371 (c)(1),
(2) Date: Mar. 9, 2016

(87) PCT Pub. No.: WO2015/056421
PCT Pub. Date: Apr. 23, 2015

(65) Prior Publication Data

US 2016/0222990 A1 Aug. 4, 2016

(30) Foreign Application Priority Data

Oct. 15, 2013 (JP) ..... 2013-214607

(51) Int. Cl.
*F15B 11/16* (2006.01)
*F15B 11/17* (2006.01)
(Continued)

(52) U.S. Cl.
CPC ..... *F15B 11/165* (2013.01); *E02F 3/28* (2013.01); *E02F 3/422* (2013.01); *E02F 3/425* (2013.01);
(Continued)

(58) Field of Classification Search
CPC ..... F15B 11/165; F15B 11/167; F15B 11/17
See application file for complete search history.

(56) References Cited

U.S. PATENT DOCUMENTS 4,606,313 A * 8/1986 Izumi ..... B60W 10/06 123/357
5,568,727 A * 10/1996 Chung ..... E02F 9/2239 60/421
(Continued)

FOREIGN PATENT DOCUMENTS

JP S57-173533 A 10/1982
JP H11-101183 A 4/1999
JP 2011-157790 A 8/2011

OTHER PUBLICATIONS

Dec. 22, 2014 International Search Report issued in International Patent Application No. PCT/JP2014/005091.
(Continued)

*Primary Examiner* — F. Daniel Lopez
*Assistant Examiner* — Matthew Wiblin
(74) *Attorney, Agent, or Firm* — Oliff PLC

(57) ABSTRACT

In a hydraulic drive system, first and second multi-control valves are connected to first and second hydraulic pumps. A first regulator adjusts a tilting angle of the first hydraulic pump in a manner to decrease a discharge flow rate of the first hydraulic pump in accordance with an increase in a discharge pressure of the first hydraulic pump and an increase in a first power shift pressure. A second regulator adjusts a tilting angle of the second hydraulic pump in a manner to decrease a discharge flow rate of the second hydraulic pump in accordance with an increase in a discharge pressure of the second hydraulic pump and an increase in a second power shift pressure. The first power
(Continued)

shift pressure is set by a first proportional valve, and the second power shift pressure is set by a second proportional valve.

9 Claims, 9 Drawing Sheets

(51) Int. Cl.
*E02F 9/22* (2006.01)
*E02F 3/28* (2006.01)
*E02F 3/42* (2006.01)
*E02F 9/12* (2006.01)

(52) U.S. Cl.
CPC ..... *E02F 9/123* (2013.01); *E02F 9/2235* (2013.01); *E02F 9/2267* (2013.01); *E02F 9/2282* (2013.01); *E02F 9/2292* (2013.01); *E02F 9/2296* (2013.01); *F15B 11/17* (2013.01); *F15B 2211/20523* (2013.01); *F15B 2211/20546* (2013.01); *F15B 2211/20553* (2013.01); *F15B 2211/20576* (2013.01); *F15B 2211/45* (2013.01); *F15B 2211/6316* (2013.01); *F15B 2211/6346* (2013.01); *F15B 2211/6652* (2013.01)

(56) References Cited

U.S. PATENT DOCUMENTS

2003/0019681 A1* 1/2003 Nakamura ..... E02F 9/2235 180/307
2008/0223027 A1* 9/2008 Koo ..... E02F 9/2239 60/428
2009/0025380 A1* 1/2009 Harsia ..... F15B 11/163 60/420
2009/0173067 A1* 7/2009 Pack ..... F15B 11/163 60/422
2012/0285157 A1* 11/2012 Okano ..... E02F 9/2282 60/445
2016/0251833 A1* 9/2016 Kondo ..... E02F 9/2235 60/428
2016/0252107 A1* 9/2016 Kondo ..... E02F 9/2235 60/428

OTHER PUBLICATIONS

Apr. 19, 2016 International Preliminary Report on Patentability issued in International Patent Application No. PCT/JP2014/005091.

* cited by examiner

HYDRAULIC DRIVE SYSTEM

TECHNICAL FIELD

The present invention relates to a hydraulic drive system of a construction machine including a turning hydraulic motor.

BACKGROUND ART

In a construction machine such as a hydraulic excavator, generally speaking, hydraulic oil is supplied to various hydraulic actuators from a hydraulic pump driven by an engine. A variable displacement pump, such as a swash plate pump or a bent axis pump, is used as the hydraulic pump. By changing the tilting angle of the hydraulic pump, the flow rate of the hydraulic oil discharged from the hydraulic pump is changed.

In general, the tilting angle of the hydraulic pump is adjusted by a regulator. For example, Patent Literature 1 discloses a hydraulic drive system that includes: two hydraulic pumps driven by one engine; and two regulators that adjust tilting angles of the respective hydraulic pumps. In the hydraulic drive system, in order to prevent an engine stall due to overload, horsepower control is performed so that the total horsepower of the hydraulic pumps will not exceed the engine output.

Specifically, in Patent Literature 1, discharge pressures of the two respective hydraulic pumps are led to each regulator. One of the discharge pressures is the discharge pressure of a regulator-side hydraulic pump coupled to the regulator, and the other discharge pressure is the discharge pressure of a counterpart hydraulic pump coupled to the other regulator. Each regulator increases the tilting angle of the regulator-side hydraulic pump in accordance with an increase in the discharge pressure of the regulator-side hydraulic pump and an increase in the discharge pressure of the counterpart hydraulic pump, thereby increasing the discharge flow rate of the regulator-side hydraulic pump. That is, the tilting angles of the two hydraulic pumps are always kept equal to each other. A control pressure from a proportional valve is also led to both the regulators, and the tilting angles of both the hydraulic pumps are increased in accordance with an increase in the control pressure. It should be noted that, in this technical field, horsepower control based on the discharge pressures of the regulator-side hydraulic pump and the counterpart hydraulic pump is often called total horsepower control, and horsepower control based on the control pressure is often called power shift control.

To be more specific, each regulator includes: a servo cylinder coupled to the regulator-side hydraulic pump; a spool for controlling the servo cylinder; and a horsepower control piston that pushes the spool in such a direction as to increase the discharge flow rate of the regulator-side hydraulic pump in accordance with an increase in the discharge pressure of the regulator-side hydraulic pump, an increase in the discharge pressure of the counterpart hydraulic pump, and an increase in the control pressure.

The hydraulic drive system disclosed in Patent Literature 1 is intended for a hydraulic excavator, and one of the hydraulic pumps supplies the hydraulic oil to, for example, a turning hydraulic motor via a control valve, and the other hydraulic pump supplies the hydraulic oil to, for example, a bucket cylinder via a control valve.

CITATION LIST

Patent Literature

PTL 1: Japanese Laid-Open Patent Application Publication No. H11-101183

SUMMARY OF INVENTION

Technical Problem

In the hydraulic drive system disclosed in Patent Literature 1, it is conceivable to reverse the direction in which the horsepower control piston of each regulator pushes the spool. In other words, each regulator is configured to decrease the discharge flow rate of the regulator-side hydraulic pump in accordance with an increase in the discharge pressure of the regulator-side hydraulic pump, an increase in the discharge pressure of the counterpart hydraulic pump, and an increase in the control pressure. This configuration provides an advantage that when no load is on one of the hydraulic pumps, the discharge flow rate of the other hydraulic pump can be increased. For example, in FIG. 9A, a solid line A indicates performance characteristics of one of the hydraulic pumps when the same load is on the one hydraulic pump and the other hydraulic pump, and a one-dot chain line B indicates performance characteristics of the one hydraulic pump when no load is on the other hydraulic pump. The aforementioned advantage is effective, for example, in a case where a bucket operation is performed alone.

However, in a case where a turning operation is performed alone, in the initial stage of the operation in which a turning unit that is caused to turn by a turning hydraulic motor starts turning, the discharge flow rate increased owing to the aforementioned advantage becomes excessively high. The reason for this is that since the weight (strictly speaking, inertia) of the turning unit of a construction machine is great, a high flow rate is unnecessary in the beginning of turning acceleration. Surplus hydraulic oil supplied to the turning hydraulic motor at the time of turning acceleration is released from a relief valve of the turning hydraulic motor. Thus, in a case where a turning operation is performed alone, the energy is consumed wastefully at the time of turning acceleration.

In view of the above, an object of the present invention is to provide a hydraulic drive system capable of suppressing wasteful energy consumption at the time of turning acceleration.

Solution to Problem

In order to solve the above-described problems, a hydraulic drive system according to the present invention, which is a hydraulic drive system of a construction machine including a turning hydraulic motor, includes: a first hydraulic pump and a second hydraulic pump driven by an engine, each pump discharging hydraulic oil at a flow rate corresponding to a tilting angle of the pump; a first multi-control valve connected to the first hydraulic pump and including a turning spool for controlling the turning hydraulic motor; a second multi-control valve connected to the second hydraulic pump; a first regulator that adjusts the tilting angle of the first hydraulic pump in a manner to decrease a discharge flow rate of the first hydraulic pump in accordance with an increase in a discharge pressure of the first hydraulic pump and an increase in a first power shift pressure; a first proportional valve that sets the first power shift pressure led to the first regulator; a second regulator that adjusts the tilting angle of the second hydraulic pump in a manner to decrease a discharge flow rate of the second hydraulic pump in accordance with an increase in a discharge pressure of the second hydraulic pump and an increase in a second power shift pressure; and a second proportional valve that sets the second power shift pressure led to the second regulator.

According to the above configuration, the discharge flow rate of the first hydraulic pump does not depend on the discharge pressure of the second hydraulic pump, and does not change in accordance with a load on the second hydraulic pump. Accordingly, the discharge flow rate of the first hydraulic pump will not become excessively high when a turning operation is performed. This makes it possible to suppress wasteful energy consumption at the time of turning acceleration.

The above hydraulic drive system may further include a controller that controls the first proportional valve and the second proportional valve. The controller may control the first proportional valve in a manner to increase the first power shift pressure such that the discharge flow rate of the first hydraulic pump decreases either when the turning spool has moved alone or when the turning spool has moved and one or a plurality of spools included in the second multi-control valve have moved in such a direction that a necessary flow rate is low. This configuration makes it possible to effectively suppress wasteful energy consumption at the time of turning acceleration when a turning operation is performed alone or when operations similar to a turning operation alone are performed.

The above hydraulic drive system may further include: a spool movement detection line that extends through monitoring spools including the turning spool in a manner to extend over the first multi-control valve and the second multi-control valve; a monitoring pressure detector for detecting that the spool movement detection line has been blocked; and a turning pressure detector for detecting that a pilot pressure has been generated in a pilot circuit that moves the turning spool. The turning spool may be configured not to block the spool movement detection line even when the turning spool has moved. According to this configuration, a turning operation being performed alone can be detected by a simple configuration.

Alternatively, the above hydraulic drive system may further include: a spool movement detection line that extends through monitoring spools including the turning spool in a manner to extend over the first multi-control valve and the second multi-control valve; a turning pressure detector for detecting that a pilot pressure has been generated in a pilot circuit that moves the turning spool; and a non-turning pressure detector for detecting that a pilot pressure has been generated in any of pilot circuits that move the monitoring spools except the turning spool. The turning spool may be configured to block the spool movement detection line when the turning spool has moved. According to this configuration, a turning operation being performed alone can be detected by using a turning spool with an ordinary structure.

The construction machine may be a hydraulic excavator including a bucket, an arm, and a boom. The second multi-control valve may include a bucket spool and a boom spool, each of which serves as one of the monitoring spools. The bucket spool may be configured not to block the spool movement detection line even when the bucket spool has moved in a bucket-out direction. The boom spool may be configured not to block the spool movement detection line even when the boom spool has moved in a boom-lowering direction. The above hydraulic drive system may further include: a bucket-out pressure detector for detecting that a pilot pressure has been generated in a bucket-out line in a pilot circuit that moves the bucket spool; and a boom-lowering pressure detector for detecting that a pilot pressure has been generated in a boom-lowering line in a pilot circuit that moves the boom spool. This configuration makes it possible to detect not only a turning operation but also a bucket-out operation and a boom-lowering operation, for which a necessary flow rate is low. Accordingly, wasteful energy consumption can be effectively suppressed at the time of turning acceleration when the following frequently-performed operations are performed: when a turning operation and a boom-lowering operation are performed at the same time; when a turning operation and a bucket-out operation are performed at the same time; and when a turning operation, a boom-lowering operation, and a bucket-out operation are performed at the same time.

The construction machine may be a hydraulic excavator including a bucket. The second multi-control valve may include a bucket spool. The controller may control the second proportional valve in a manner to decrease the second power shift pressure such that the discharge flow rate of the second hydraulic pump increases when the bucket spool has moved alone. According to this configuration, when a bucket operation is performed alone, a large part of the output from the engine can be used in the bucket work.

The construction machine may be a hydraulic excavator including a bucket, an arm, and a boom. The above hydraulic drive system may further include a spool movement detection line that extends though monitoring spools including the turning spool in a manner to extend over the first multi-control valve and the second multi-control valve. The first multi-control valve or the second multi-control valve may include an arm spool that serves as one of the monitoring spools. The second multi-control valve may include a bucket spool and a boom spool, each of which serves as one of the monitoring spools. Each of the turning spool, the arm spool, the bucket spool, and the boom spool may be configured to block the spool movement detection line when having moved. Each of pilot circuits that move the turning spool, the arm spool, the bucket spool, and the boom spool, respectively, may be provided with a pressure detector for detecting that a pilot pressure has been generated in the pilot circuit. According to this configuration, a hydraulic drive system incorporated in an existing construction machine can be modified to be the hydraulic drive system of the present invention at low cost.

Advantageous Effects of Invention

According to the present invention, wasteful energy consumption at the time of turning acceleration can be suppressed.

DESCRIPTION OF EMBODIMENTS

Embodiment 1

Figure 1:
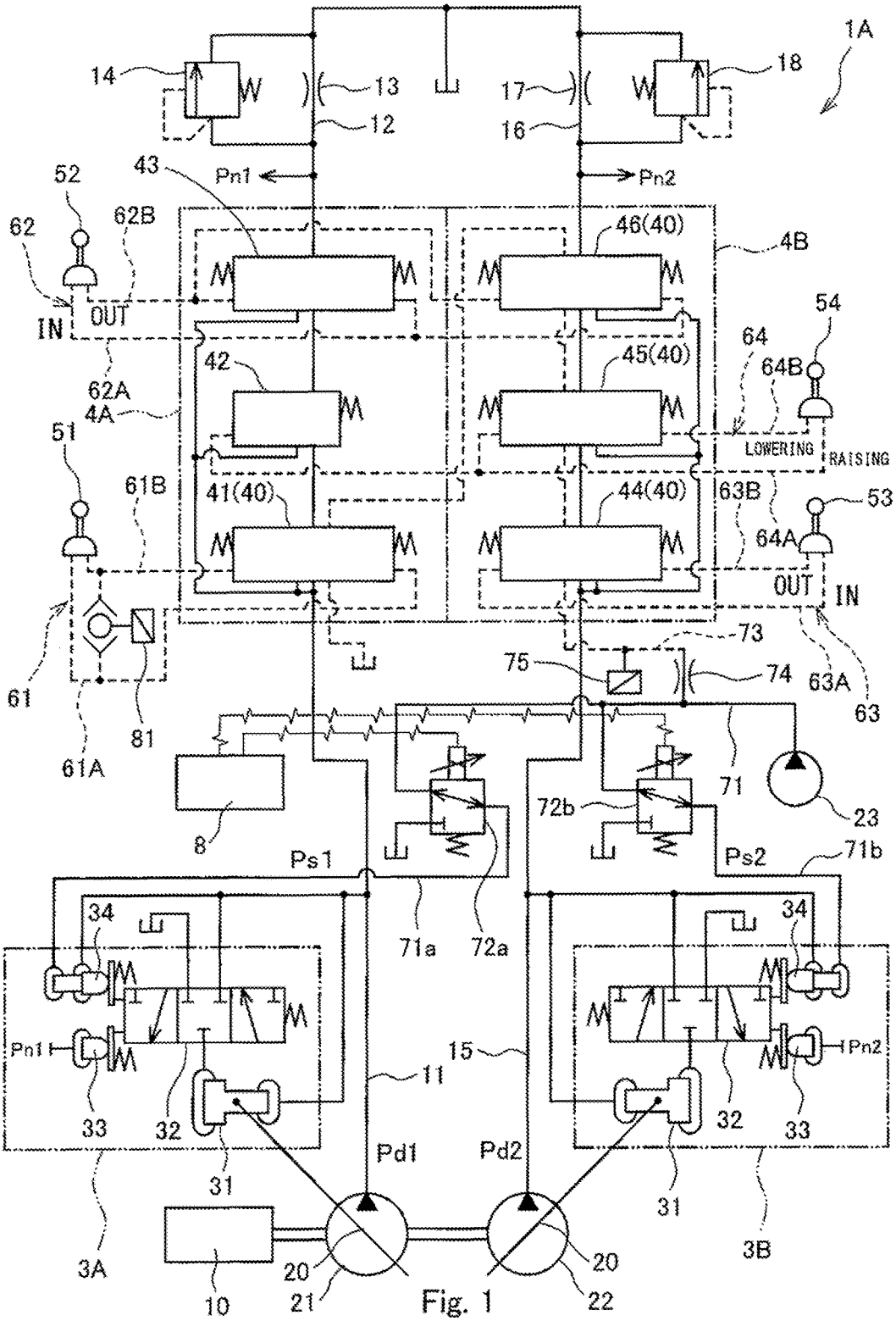
FIG. 1 shows an overall hydraulic circuit of a hydraulic drive system according to Embodiment 1 of the present invention.
Figure 2:
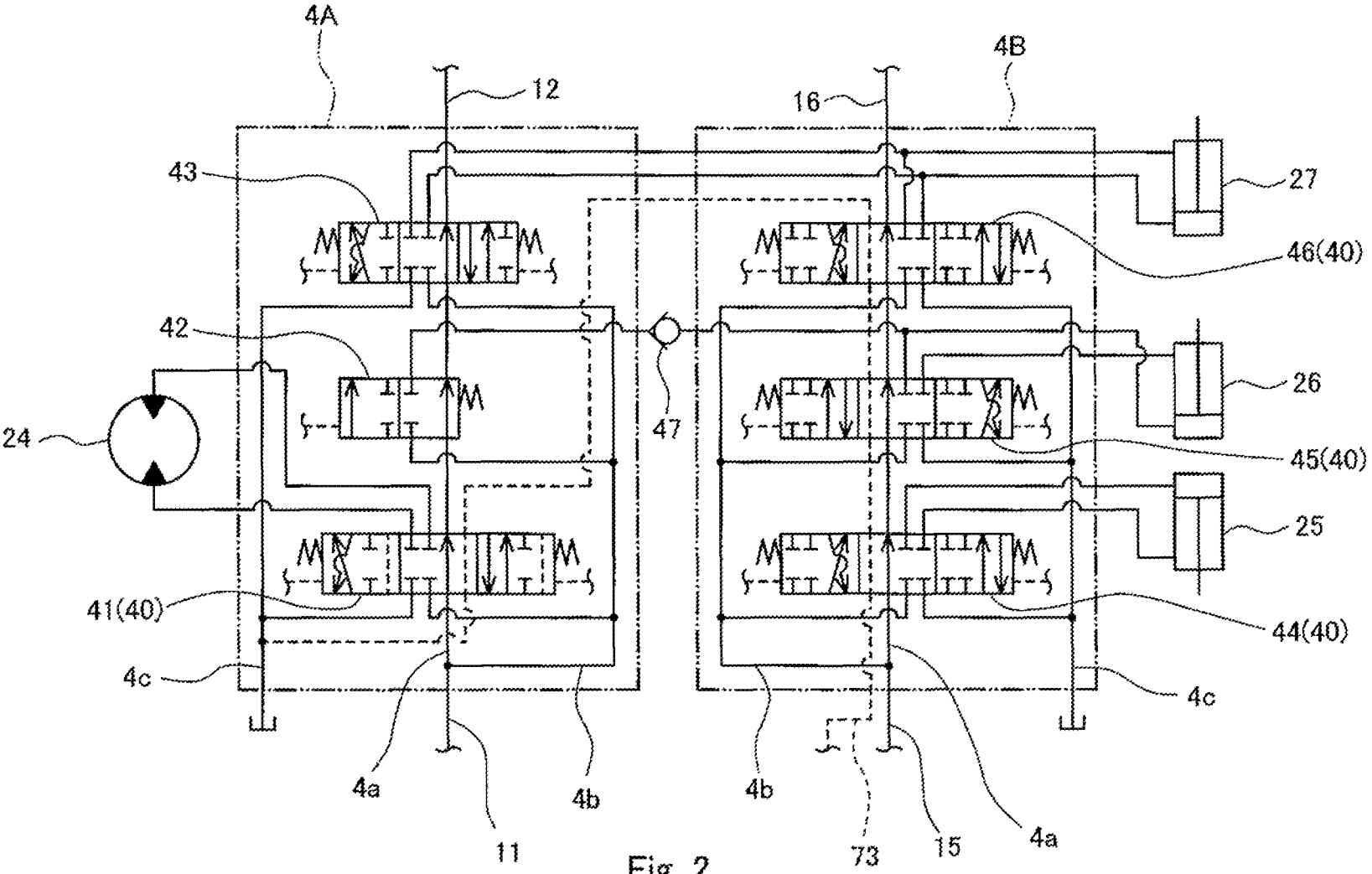
FIG. 2 shows a hydraulic circuit in Embodiment 1 from first and second multi-control valves to hydraulic actuators.

FIG. 1 and FIG. 2 each show a hydraulic drive system 1A according to Embodiment 1 of the present invention. FIG. 1 shows an overall hydraulic circuit of the hydraulic drive system 1A, and schematically shows an internal configuration of each of first and second multi-control valves 4A and 4B, which will be described below. FIG. 2 shows a hydraulic circuit from the first and second multi-control valves 4A and 4B to hydraulic actuators.

The hydraulic drive system 1A is intended for a construction machine that includes a turning hydraulic motor. In the present embodiment, the construction machine is a hydraulic excavator. However, the construction machine for which the hydraulic drive system 1A is intended is not necessarily a hydraulic excavator, but may be a hydraulic crane, for example.

For example, the hydraulic excavator of a self-propelled type includes: a running unit; a body that turns relative to the running unit, the body including an operator cab; a boom that is raised and lowered relative to the body; an arm swingably coupled to the distal end of the boom; and a bucket swingably coupled to the distal end of the arm. That is, a set of the body, the boom, the arm, and the bucket is a turning unit caused to turn by a turning hydraulic motor 24, which will be described below. In a case where the hydraulic excavator is mounted on a ship, the body is turnably supported by the hull of the ship.

As shown in FIG. 2, the hydraulic drive system 1A includes the turning hydraulic motor 24, a bucket cylinder 25, a boom cylinder 26, and an arm cylinder 27 as hydraulic actuators. As shown in FIG. 1, the hydraulic drive system 1A further includes a first hydraulic pump 21 and a second hydraulic pump 22, which supply hydraulic oil to these hydraulic actuators. The first hydraulic pump 21 supplies the hydraulic oil to the turning hydraulic motor 24, the boom cylinder 26, and the arm cylinder 27 via the first multi-control valve 4A. The second hydraulic pump 22 supplies the hydraulic oil to the bucket cylinder 25, the boom cylinder 26, and the arm cylinder 27 via the second multi-control valve 4B.

To be more specific, the first hydraulic pump 21 is connected to the first multi-control valve 4A by a first supply line 11. A first center bleed line 12, which leads the hydraulic oil that has passed through the first multi-control valve 4A to a tank, extends from the first multi-control valve 4A. Similarly, the second hydraulic pump 22 is connected to the second multi-control valve 4B by a second supply line 15. A second center bleed line 16, which leads the hydraulic oil that has passed through the second multi-control valve 4B to the tank, extends from the second multi-control valve 4B.

In the present embodiment, the discharge flow rate of the first hydraulic pump 21 and the discharge flow rate of the second hydraulic pump 22 are controlled by a negative control method. Specifically, the first center bleed line 12 is provided with a throttle 13, and a relief valve 14 is disposed on a passage that bypasses the throttle 13. Similarly, the second center bleed line 16 is provided with a throttle 17, and a relief valve 18 is disposed on a passage that bypasses the throttle 17. It should be noted that the relief valve 14 and the throttle 13 may be incorporated in the first multi-control valve 4A, and the relief valve 18 and the throttle 17 may be incorporated in the second multi-control valve 4B.

The first multi-control valve 4A and the second multi-control valve 4B are open center valves, each of which includes a plurality of spools. Specifically, in the multi-control valve (4A or 4B), when all the spools are at their neutral positions, the amount of hydraulic oil flowing from the supply line (11 or 15) to the center bleed line (12 or 16) is not restricted. On the other hand, when any of the spools moves and shifts from its neutral position, the amount of hydraulic oil flowing from the supply line (11 or 15) to the center bleed line (12 or 16) is restricted by the spool.

To be more specific, as shown in FIG. 2, the first multi-control valve 4A includes a turning spool 41 for controlling the turning hydraulic motor 24, and the second multi-control valve 4B includes a bucket spool 44 for controlling the bucket cylinder 25. The first multi-control valve 4A further includes a boom spool 42 for controlling the boom cylinder 26 and an arm spool 43 for controlling the arm cylinder 27. The second multi-control valve 4B further includes a boom spool 45 for controlling the boom cylinder 26 and an arm spool 46 for controlling the arm cylinder 27. The boom spool 45 of the second multi-control valve 4B is a spool for realizing a first speed, and the boom spool 42 of the first multi-control valve 4A is a spool for moving together with the boom spool 45 to realize a second speed faster than the first speed. A check valve 47 is disposed on a line extending from the boom spool 42, the line merging with a head-side line between the boom spool 45 and the boom cylinder 26. The arm spool 43 of the first multi-control valve 4A is a spool for realizing a first speed, and the arm spool 46 of the second multi-control valve 4B is a spool for moving together with the arm spool 43 to realize a second speed faster than the first speed. Only the boom spool 42 for realizing the second speed of the boom is a two-position spool, and the other spools are three-position spools.

A central passage 4*a*, a parallel passage 4*b*, and a tank passage 4*c* are formed in each of the first multi-control valve 4A and the second multi-control valve 4B. In each multi-control valve, the central passage 4*a* crosses through all the spools, and connects the supply line (11 or 15) and the center bleed line (12 or 16); the parallel passage 4*b* leads the hydraulic oil from the central passage 4*a* to each of the spools; and the tank passage 4*c* leads the hydraulic oil from each of the spools (except the boom spool 42) to the tank.

It should be noted that the positions of the spools 41 to 46 are not particularly limited, and are not necessarily as shown in FIG. 2. For example, the bucket spool 44 may be disposed downstream of the boom spool 45 and upstream of the arm spool 46. In the case of a self-propelled hydraulic excavator, each of the first multi-control valve 4A and the second multi-control valve 4B may include a running spool for controlling a hydraulic motor for running. In addition, one of or both the first multi-control valve 4A and the second multi-control valve 4B may include one or a plurality of optional spools.

A turning pilot circuit 61, which moves the turning spool 41, includes a right turn line 61A and a left turn line 61B each extending from a turning operating valve 51 to the turning spool 41. A bucket pilot circuit 63, which moves the bucket spool 44, includes a bucket-in line 63A and a bucket-out line 63B each extending from a bucket operating valve 53 to the bucket spool 44. A boom pilot circuit 64, which moves the boom spools 42 and 45, includes a boom-raising line 64A and a boom-lowering line 64B, the boom-raising line 64A extending from a boom operating valve 54 to the boom spools 42 and 45, the boom-lowering line 64B extending from the boom operating valve 54 to the boom spool 45. An arm pilot circuit 62, which moves the arm spools 43 and 46, includes an arm-in line 62A and an arm-out line 62B each extending from an arm operating valve 52 to the arm spools 43 and 46. Each of the operating valves 51 to 54 includes an operating lever. When one of the operating levers is tilted, a pilot pressure is generated in one of the pilot lines (61A to 64B) in the pilot circuits (61 to 64), the one pilot line being positioned in a direction in which the one operating lever has been tilted, and consequently, the corresponding spool/spools (among the spools 41 to 46) move(s).

Each of the first hydraulic pump 21 and the second hydraulic pump 22 is driven by an engine 10, and discharges the hydraulic oil at a flow rate corresponding to the tilting angle of the pump. In the present embodiment, swash plate pumps each defining its tilting angle by the angle of a swash plate 20 are adopted as the first hydraulic pump 21 and the second hydraulic pump 22. However, as an alternative, bent axis pumps each defining the tilting angle by the angle of its axis may be adopted as the first hydraulic pump 21 and the second hydraulic pump 22.

The tilting angle of the first hydraulic pump 21 is adjusted by a first regulator 3A, and the tilting angle of the second hydraulic pump 22 is adjusted by a second regulator 3B. The less the tilting angle of the hydraulic pump (21 or 22), the lower the discharge flow rate of the hydraulic pump. The greater the tilting angle of the hydraulic pump, the higher the discharge flow rate of the hydraulic pump.

The first regulator 3A includes: a servo cylinder 31 coupled to the swash plate 20 of the first hydraulic pump 21; a spool 32 for controlling the servo cylinder 31; and a negative control piston 33 and a horsepower control piston 34 for moving the spool 32.

A smaller-diameter-side pressure receiving chamber of the servo cylinder 31 is in communication with the first supply line 11. The spool 32 controls the area of opening of a line that allows a greater-diameter-side pressure receiving chamber of the servo cylinder 31 to communicate with the first supply line 11, and also controls the area of opening of a line that allows the greater-diameter-side pressure receiving chamber to communicate with the tank. The servo cylinder 31 decreases the tilting angle of the first hydraulic pump 21 when the greater-diameter-side pressure receiving chamber communicates with the first supply line 11 by a greater area of opening. The servo cylinder 31 increases the tinging angle of the first hydraulic pump 21 when the greater-diameter-side pressure receiving chamber communicates with the tank by a greater area of opening. The negative control piston 33 and the horsepower control piston 34 push the spool 32 in such a direction as to allow the greater-diameter-side pressure receiving chamber of the servo cylinder 31 to communicate with the first supply line 11, i.e., in such a direction as to decrease the discharge flow rate of the first hydraulic pump 21.

A pressure receiving chamber for causing the negative control piston 33 to push the spool 32 is formed in the first regulator 3A. A first negative control pressure Pn1, which is the pressure at the upstream side of the throttle 13 on the first center bleed line 12, is led to the pressure receiving chamber of the negative control piston 33. The first negative control pressure Pn1 is determined by the degree of restriction, by the spools, of the hydraulic oil that flows through the central passage 4*a*. When the first negative control pressure Pn1 increases, the negative control piston 33 advances and thereby the tilting angle of the first hydraulic pump 21 decreases. When the first negative control pressure Pn1 decreases, the negative control piston 33 retreats and thereby the tilting angle of the first hydraulic pump 21 increases.

The horsepower control piston 34 is a piston for decreasing the discharge flow rate of the first hydraulic pump 21 in accordance with an increase in a discharge pressure Pd1 of the first hydraulic pump 21 and an increase in a first power shift pressure Ps1. To be specific, two pressure receiving chambers for causing the horsepower control piston 34 to push the spool 32 are formed in the first regulator 3A. The two pressure receiving chambers of the horsepower control piston 34 are connected to the first supply line 11 and a first proportional valve 72*a*, respectively. The discharge pressure Pd1 of the first hydraulic pump 21 and the first power shift pressure Ps1 are led to the pressure receiving chambers, respectively.

The first proportional valve 72*a* is a valve for setting the first power shift pressure Ps1 led to the first regulator 3A. To be more specific, the first proportional valve 72*a* is connected to one of the pressure receiving chambers of the horsepower control piston 34 in the first regulator 3A by a first power shift line 71*a*. The hydraulic oil is supplied from an auxiliary pump 23 driven by the engine 10 to the first proportional valve, 72*a* through a pilot pressure supply line 71.

It should be noted that the negative control piston 33 and the horsepower control piston 34 are configured such that pushing of the spool 32 by one of these pistons is prioritized over pushing of the spool 32 by the other piston, the one piston restricting (decreasing) the discharge flow rate of the first hydraulic pump 21 to a greater degree than the other piston.

The second regulator 3B is configured in the same manner as the first regulator 3A. Specifically, the second regulator 3B adjusts the tilting angle of the second hydraulic pump 22 by the negative control piston 33 based on a second negative control pressure Pn2. The second regulator 3B also adjusts the tilting angle of the second hydraulic pump 22 by the horsepower control piston 34, such that the discharge flow rate of the second hydraulic pump 22 decreases in accordance with an increase in a discharge pressure Pd2 of the second hydraulic pump 22 and an increase in a second power shift pressure Ps2. The second power shift pressure Ps2, which is led to the second regulator 3B, is set by a second proportional valve 72*b*. The second proportional valve 72*b* is connected to one of the pressure receiving chambers of the horsepower control piston 34 in the second regulator 3B by a second power shift line 71*b*. The hydraulic oil is supplied from the auxiliary pump 23 to the second proportional valve 72*b* through the pilot pressure supply line 71.

The first proportional valve 72*a* and the second proportional valve 72*b* are controlled by a controller 8. The controller 8 includes an arithmetic operation device, a storage device, etc. In the present embodiment, the controller 8 controls the first proportional valve 72*a* in a manner to increase the first power shift pressure Ps1 such that the discharge flow rate of the first hydraulic pump 21 decreases when the turning spool 41 has moved alone. Hereinafter, a configuration for performing the control is described.

The turning pilot circuit 61 is provided with a turning pressure detector 81 for detecting that a pilot pressure has been generated in the turning pilot circuit 61, i.e., that the operating lever of the turning operating valve 51 has been tilted. The turning pressure detector 81 is configured to selectively detect a higher one of the pilot pressures of a pair of pilot lines that are the right turn line 61A and the left turn line 61B. In the present embodiment, a pressure sensor is used as the turning pressure detector 81. However, as an alternative, the turning pressure detector 81 may be a pressure switch that turns on or off when a pilot pressure is generated in the turning pilot circuit 61.

A spool movement detection line 73 branches off from the pilot pressure supply line 71. The spool movement detection line 73 extends through monitoring spools 40 in a manner to extend over the first multi-control valve 4A and the second multi-control valve 4B, and is connected to the tank.

In the present embodiment, the monitoring spools 40 are the following spools: the turning spool 41 of the first multi-control valve 4A; and the bucket spool 44, the boom spool 45, and the arm spool 46 of the second multi-control valve 4B. However, there is of course no particular restriction in what order the spool movement detection line 73 passes through these monitoring spools 40. In place of the boom spool 45 and the arm spool 46 of the second multi-control valve 4B, the boom spool 42 and the arm spool 43 of the first multi-control valve 4A may be adopted as monitoring spools 40. Moreover, in a case where the first multi-control valve 4A or the second multi-control valve 4B includes an optional spool, the optional spool may be included as one of the monitoring spools 40.

As shown in FIG. 2, the turning spool 41 is configured not to block the spool movement detection line 73 whether the turning spool 41 is positioned at its neutral position or the turning spool 41 has moved (i.e., the turning spool 41 has shifted from the neutral position). On the other hand, each of the other monitoring spools 40 different from the turning spool is configured not to block the spool movement detection line 73 when positioned at its neutral position, but to block the spool movement detection line 73 when having moved (i.e., when having shifted from the neutral position). That is, the spool movement detection line 73 is not blocked when the turning operating valve 51 is operated alone, but is blocked when any of the bucket operating valve 53, the boom operating valve 54, and the arm operating valve 52 is operated.

The upstream side of the spool movement detection line 73 is provided with a throttle 74 for preventing an excessive decrease in the pressure of the pilot pressure supply line 71 even when all of the monitoring spools are at their neutral positions. The spool movement detection line 73 is provided with a monitoring pressure detector 75 for detecting that the spool movement detection line 73 has been blocked, the monitoring pressure detector 75 being positioned between the throttle 74 and the second multi-control valve 4B. In the present embodiment, a pressure sensor is used as the monitoring pressure detector 75. However, as an alternative, the monitoring pressure detector 75 may be a pressure switch that turns on or off when the spool movement detection line 73 is blocked.

In a case where it is determined by use of the turning pressure detector 81 and the monitoring pressure detector 75 that the turning operating valve 51 has been operated alone, the controller 8 controls the first proportional valve 72*a* in a manner to increase the first power shift pressure Ps1. As a result, the discharge flow rate of the first hydraulic pump 21 decreases. Consequently, the amount of hydraulic oil supplied to the turning hydraulic motor 24 at the time of turning acceleration can be reduced, which makes it possible to suppress wasteful energy consumption. It should be noted that when the period of the turning acceleration has elapsed, the controller 8 may control the first proportional valve 72*a* in a manner to bring back the first power shift pressure Ps1.

Figure 9A:
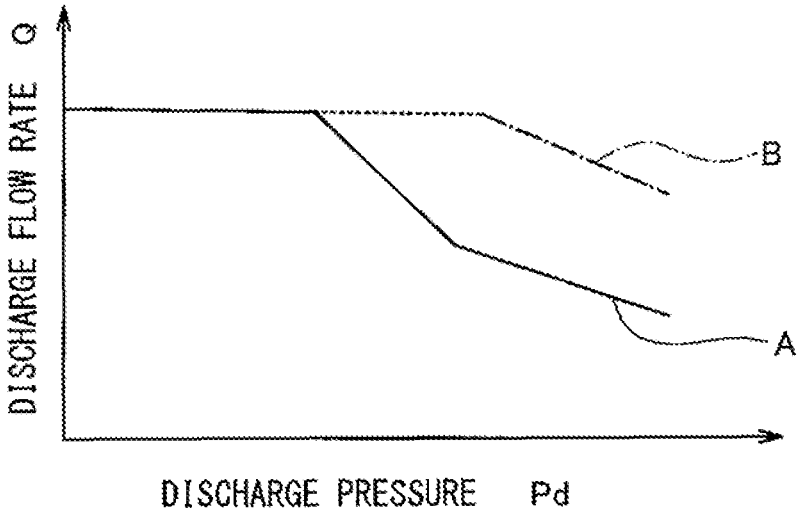
FIG. 9A is a graph showing performance characteristics of one of hydraulic pumps in a conventional hydraulic drive system.
Figure 9B:
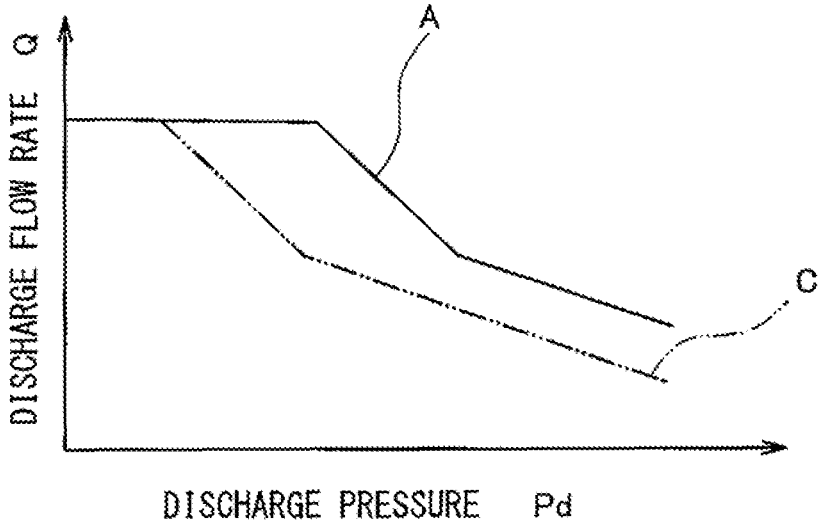
FIG. 9B is a graph showing performance characteristics of a first hydraulic pump in Embodiment 1.

In FIG. 9B, a two-dot chain line C indicates performance characteristics of the first hydraulic pump 21 when the first power shift pressure Ps1 is increased. A solid line A in FIG. 9B indicates performance characteristics of the first hydraulic pump 21 when the first power shift pressure Ps1 is low, i.e., before the first power shift pressure is increased. It is understood from FIG. 9B that, in a case where a turning operation is performed alone, the discharge flow rate of the first hydraulic pump 21 can be kept low by increasing the first power shift pressure Ps1.

In addition, since the turning pilot circuit 61 is provided with the turning pressure detector 81 in the present embodiment, the above-described advantageous effect can be obtained with an inexpensive configuration compared to a case where the first supply line 11 is provided with a pressure detector. Moreover, in the present embodiment, since the first power shift pressure Ps1 is utilized in combination with the horsepower control by the regulator, an advantageous effect of being able to suppress an increase in the discharge flow rate of the first hydraulic pump 21 in a case where a turning operation is performed alone can be obtained with a simple control logic. Furthermore, as the turning acceleration advances into its latter half, a load pressure exerted on the turning hydraulic motor 24 decreases, and a high flow rate becomes necessary to increase the turning speed. In this respect, in the present embodiment, when a turning operation is performed alone, the discharge flow rate of the first hydraulic pump 21 is decreased temporarily by the function of the power shift pressure Ps; however, in the latter half of the turning acceleration, the discharge flow rate of the first hydraulic pump 21 increases automatically owing to the function of the above-described horsepower control by the regulator in accordance with a decrease in the discharge pressure Pd1 of the first hydraulic pump 21. As a result, the hydraulic oil is supplied to the turning hydraulic motor 24 at a sufficient flow rate in accordance with the load at each stage of the turning. Consequently, the operation feeling during the turning will not be impaired.

Still further, the turning spool 41 is configured not to block the spool movement detection line 73 even when the turning spool 41 has moved. Accordingly, the mere installation of the pressure detectors on the turning pilot circuit 61 and the spool movement detection line 73 makes it possible to detect that the turning operating valve 51 has been operated alone. That is, a turning operation being performed alone can be detected by a simple configuration.

It should be noted that when the controller 8 has determined that the bucket spool 44 has moved alone, the second proportional valve 72*b* may be controlled in a manner to decrease the second power shift pressure Ps2 such that the discharge flow rate of the second hydraulic pump 22 increases. With such control, when a bucket operation is performed alone, a large part of the output from the engine 10 can be used in the bucket work (for driving the bucket cylinder 25). For example, the output from the engine 10 can be fully utilized by setting the horsepower of the second hydraulic pump 22 by the second proportional valve 72*b* to be substantially the same as the output from the engine 10.

Various configurations are adoptable for detecting that the bucket spool 44 has moved alone, i.e., that the bucket operating valve 53 has been operated alone. For example, the bucket spool 44 may be configured not to block the spool movement detection line 73 even when the bucket spool 44 has moved, and also, the bucket pilot circuit 63 may be provided with a bucket pressure detector for detecting that a pilot pressure has been generated in the bucket pilot circuit 63 although such a configuration is not shown in the drawings. Alternatively, a configuration as described below in Embodiment 4 may be adopted.

<Variation>

In the above-described embodiment, when the turning spool 41 has moved alone, the first proportional valve 72*a* is controlled in a manner to increase the first power shift pressure Ps1. However, as an alternative, even when the turning spool 41 has moved alone, the first power shift pressure Ps1 may be kept constant by not performing the control of the first proportional valve 72*a*. That is, in the configuration of the first regulator 3A shown in FIG. 1, the discharge flow rate of the first hydraulic pump 21 does not depend on the discharge pressure Pd2 of the second hydraulic pump 22, and does not change in accordance with the load on the second hydraulic pump 22. In other words, the solid line A in FIG. 9B stays constant even if the load on the second hydraulic pump 22 changes. Accordingly, even if the first power shift pressure Ps1 is kept constant, the discharge flow rate of the first hydraulic pump 21 will not become excessively high when a turning operation is performed. This makes it possible to suppress wasteful energy consumption at the time of turning acceleration. However, if the configuration as described in the above embodiment is adopted, in which the first power shift pressure Ps1 increases when the turning spool 41 has moved alone, wasteful energy consumption at the time of turning acceleration can be suppressed more effectively in a case where a turning operation is performed alone. It should be noted that the variation in which the first power shift pressure Ps1 is kept constant when a turning operation is performed is applicable also to Embodiments 2 to 4, which are described below.

It is not essential for the spool movement detection line 73 to pass through the turning spool 41, and the number of ports for the turning spool 41 may be six. In this case, the spool movement detection line 73 may be provided only in the second multi-control valve 4B.

Embodiment 2

Next, a hydraulic drive system according to Embodiment 2 of the present invention is described with reference to FIG. 3 and FIG. 4. In the present embodiment and Embodiments 3 and 4 described below, the same components as those described in Embodiment 1 are denoted by the same reference signs, and repeating the same descriptions is avoided.

Figure 4:
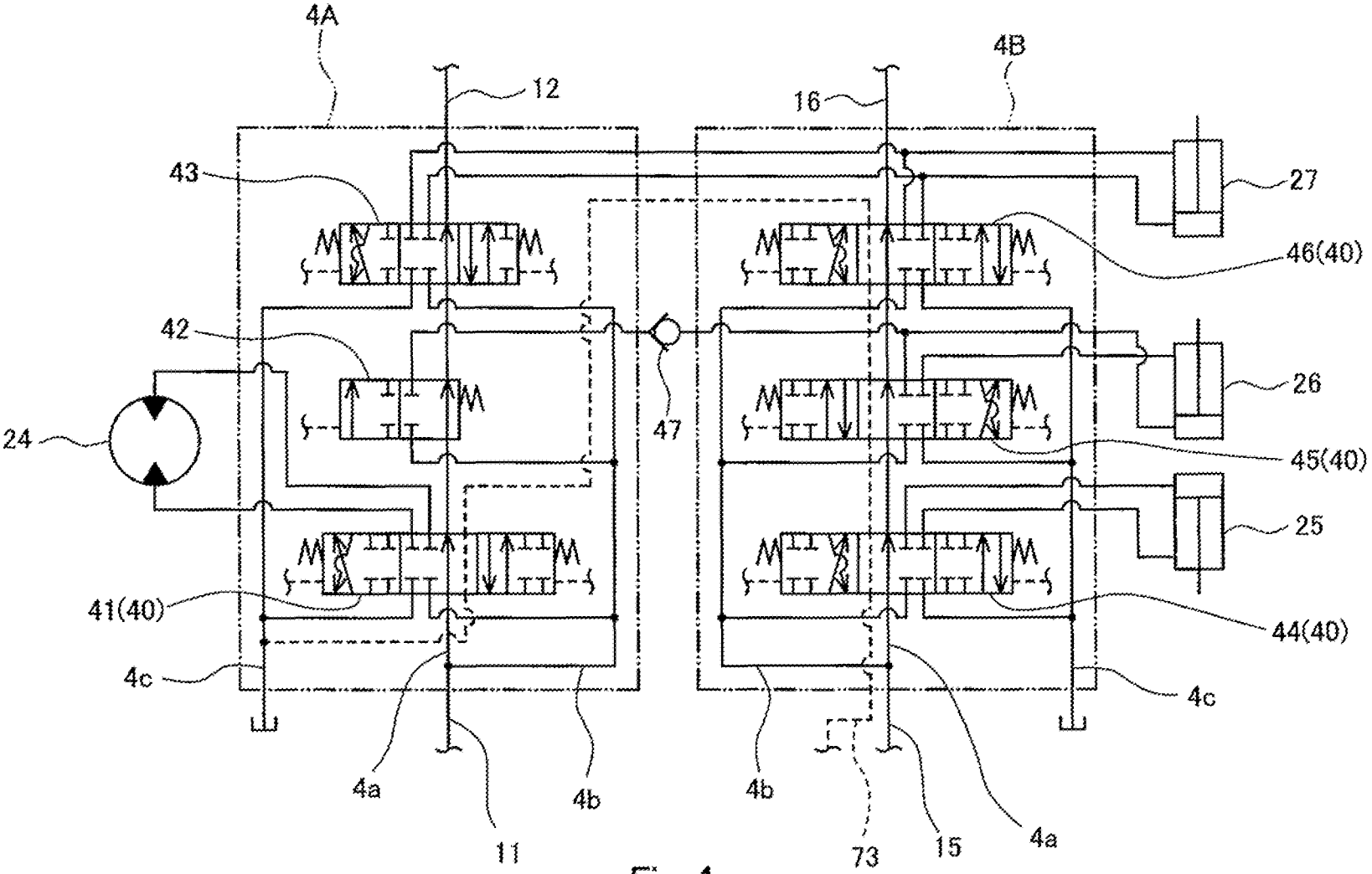
FIG. 4 shows a hydraulic circuit in Embodiment 2 from first and second multi-control valves to hydraulic actuators.

In the present embodiment, as shown in FIG. 4, the turning spool 41 is configured to block the spool movement detection line 73 when the turning spool 41 has moved, That is, the spool movement detection line 73 is blocked when any of the turning operating valve 51, the bucket operating valve 53, the boom operating valve 54, and the arm operating valve 52 (see FIG. 1 for the operating valves 51 to 54) is operated.

Figure 3:
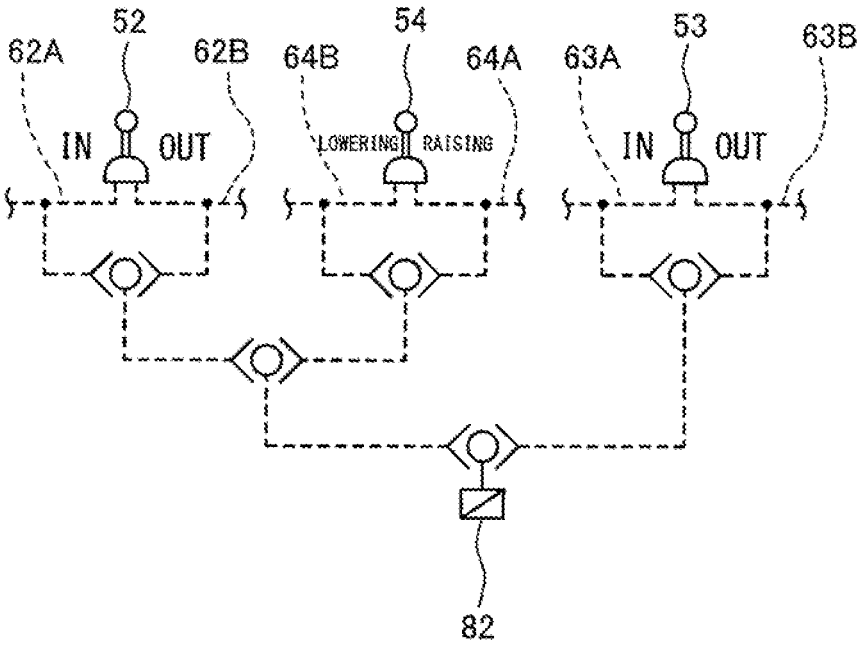
FIG. 3 shows a hydraulic circuit in Embodiment 2 of the present invention for detecting operations except a turning operation.

Accordingly, as a configuration for detecting that the turning operating valve 51 has been operated alone, a non-turning pressure detector 82 for detecting that a pilot pressure has been generated in any of the pilot circuits 62 to 64, which move the monitoring spools 40 except the turning spool 41, is provided as shown in FIG. 3. The non-turning pressure detector 82 is configured to selectively detect the highest pilot pressure among the pilot pressures of all the pilot lines (62A to 64B) in the pilot circuits 62 to 64. In the present embodiment, a pressure sensor is used as the non-turning pressure detector 82. However, as an alternative, the non-turning pressure detector 82 may be a pressure switch that turns on or off when a pilot pressure is generated in any of the pilot circuits 62 to 64.

In the present embodiment, similar to Embodiment 1, when the turning spool 41 has moved alone, the controller 8 controls the first proportional valve 72*a* in a manner to increase the first power shift pressure Ps1 such that the discharge flow rate of the first hydraulic pump 21 decreases. As a result, the same advantageous effects as those produced by Embodiment 1 can be obtained.

In the present embodiment, the turning spool 41 is configured to block the spool movement detection line 73 when the turning spool 41 has moved. Therefore, a turning operation being performed alone can be detected by using the turning spool with an ordinary structure. In other words, a hydraulic drive system incorporated in an existing construction machine can be modified to be the hydraulic drive system of the present embodiment at low cost.

Embodiment 3

Figure 5:
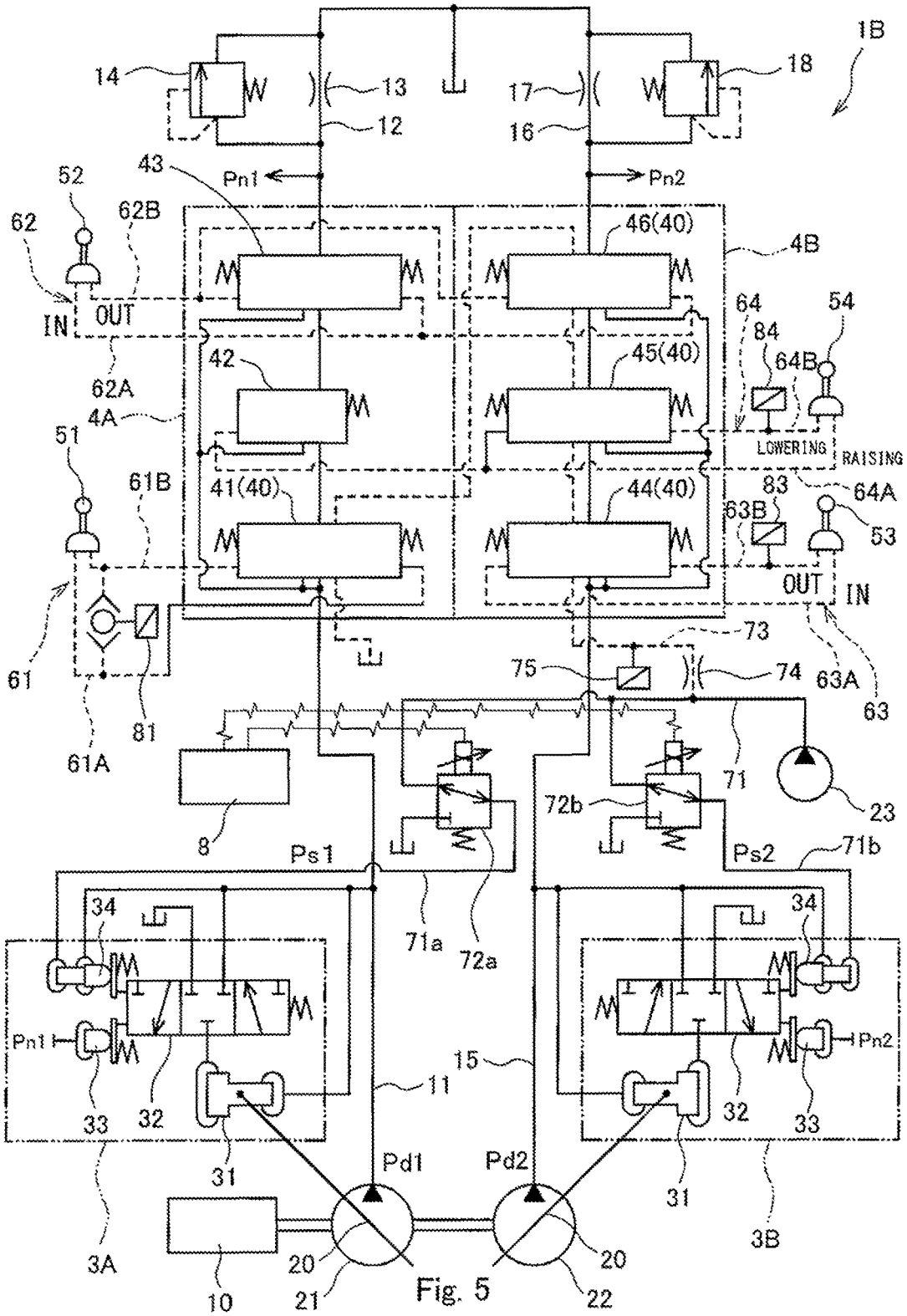
FIG. 5 shows an overall hydraulic circuit of a hydraulic drive system according to Embodiment 3 of the present invention.

Next, a hydraulic drive system 1B according to Embodiment 3 of the present invention is described with reference to FIG. 5 and FIG. 6. The present embodiment adopts a configuration that makes it possible to detect not only a turning operation but also a bucket-out operation and a boom-lowering operation, for which a necessary flow rate is low. Not only when the turning spool 41 has moved alone but also when the turning spool 41 has moved and the bucket spool 44 and/or the boom spool 45 have moved in such a direction that a necessary flow rate is low (i.e., a bucket-out direction and/or a boom-lowering direction), the controller 8 controls the first proportional valve 72*a* in a manner to increase the first power shift pressure Ps1 such that the discharge flow rate of the first hydraulic pump 21 decreases.

Figure 6:
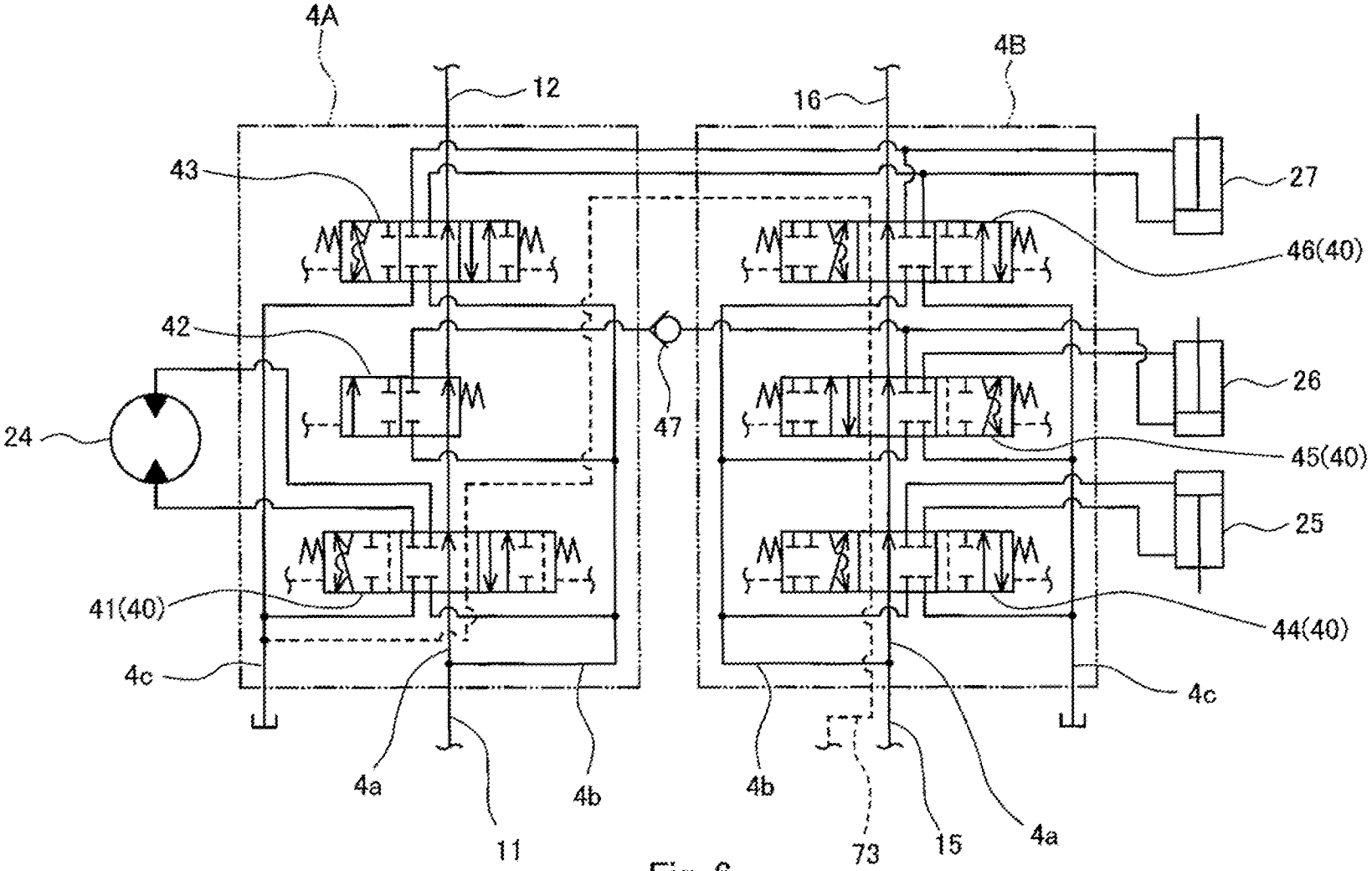
FIG. 6 shows a hydraulic circuit in Embodiment 3 from first and second multi-control valves to hydraulic actuators.

To be specific, as shown in FIG. 6, the bucket spool 44 is configured not to block the spool movement detection line 73 even when the bucket spool 44 has moved in a bucket-out direction. The bucket pilot circuit 63 is provided with a bucket-out pressure detector 83 for detecting that a pilot pressure has been generated in the bucket-out line 63B. In the present embodiment, a pressure sensor is used as the bucket-out pressure detector 83. However, as an alternative, the bucket-out pressure detector 83 may be a pressure switch that turns on or off when a pilot pressure is generated in the bucket-out line 63B.

In addition, the boom spool 45 is configured not to block the spool movement detection line 73 even when the boom spool 45 has moved in a boom-lowering direction. The boom pilot circuit 64 is provided with a boom-lowering pressure detector 84 for detecting that a pilot pressure has been generated in the boom-lowering line 64B. In the present embodiment, a pressure sensor is used as the boom-lowering pressure detector 84. However, as an alternative, the boom-lowering pressure detector 84 may be a pressure switch that turns on or off when a pilot pressure is generated in the boom-lowering line 64B.

In the four cases that are described below, the controller 8 controls the first proportional valve 72*a* in a manner to increase the first power shift pressure Ps1. As a result, the discharge flow rate of the first hydraulic pump 21 decreases. Consequently, the amount of hydraulic oil supplied to the turning hydraulic motor 24 at the time of turning acceleration can be reduced, which makes it possible to suppress wasteful energy consumption. It should be noted that when the period of the turning acceleration has elapsed, the controller 8 may control the first proportional valve 72*a* in a manner to bring back the first power shift pressure Ps1.

The first one of the aforementioned four cases is a case where it is determined that the turning operating valve 51 has been operated alone for the reason that the turning pressure detector 81 has detected a pilot pressure but the monitoring pressure detector 75, the bucket-out pressure detector 83, and the boom-lowering pressure detector 84 have been in a non-detecting state. The second one of the four cases is a case where it is determined that the turning operating valve 51 has been operated and the bucket operating valve 53 has been operated in a bucket-out direction for the reason that each of the turning pressure detector 81 and the bucket-out pressure detector 83 has detected a pilot pressure but the monitoring pressure detector 75 and the boom-lowering pressure detector 84 have been in a non-detecting state. The third one of the aforementioned four cases is a case where it is determined that the turning operating valve 51 has been operated and the boom operating valve 54 has been operated in a boom-lowering direction for the reason that each of the turning pressure detector 81 and the boom-lowering pressure detector 84 has detected a pilot pressure but the monitoring pressure detector 75 and the bucket-out pressure detector 83 have been in a non-detecting state. The fourth one of the aforementioned four cases is a case where it is determined that the turning operating valve 51 has been operated, the bucket operating valve 53 has been operated in a bucket-out direction, and the boom operating valve 54 has been operated in a boom-lowering direction for the reason that each of the turning pressure detector 81, the bucket-out pressure detector 83, and the boom-lowering pressure detector 84 has detected a pilot pressure but the monitoring pressure detector 75 has been in a non-detecting state.

The above-described configuration of the present embodiment makes it possible to effectively suppress wasteful energy consumption at the time of turning acceleration not only when a turning operation is performed alone but also when the following frequently-performed operations are performed: when a turning operation and a boom-lowering operation are performed at the same time; when a turning operation and a bucket-out operation are performed at the same time; and when a turning operation, a boom-lowering operation, and a bucket-out operation are performed at the same time.

<Variations>

It is not essential that both the bucket-out operation and the boom-lowering operation be detectable. Instead, only one of these operations may be detectable.

Figure 7:
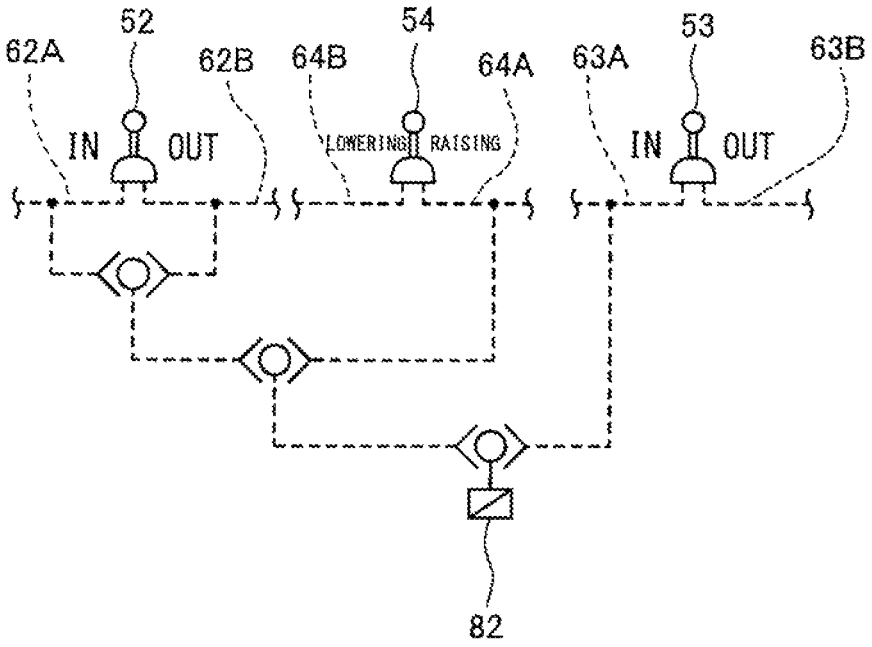
FIG. 7 shows a hydraulic circuit in Embodiment 3 for detecting operations except a turning operation, a boom-lowering operation, and a bucket-out operation.

If the non-turning pressure detector 82 shown in FIG. 7 is adopted similar to Embodiment 2, each of the turning spool 41, the bucket spool 44, and the boom spool 45 can be modified to have an ordinary structure as shown in FIG. 4 (i.e., a structure that blocks the spool movement detection line 73 when the spool has moved). In this case, since the present embodiment includes the bucket-out pressure detector 83 and the boom-lowering pressure detector 84, the boom-lowering line 64B and the bucket-out line 63B may be excluded from pilot lines from which the non-turning pressure detector 82 selectively detects a pilot pressure as shown in FIG. 7.

Embodiment 4

Figure 8:
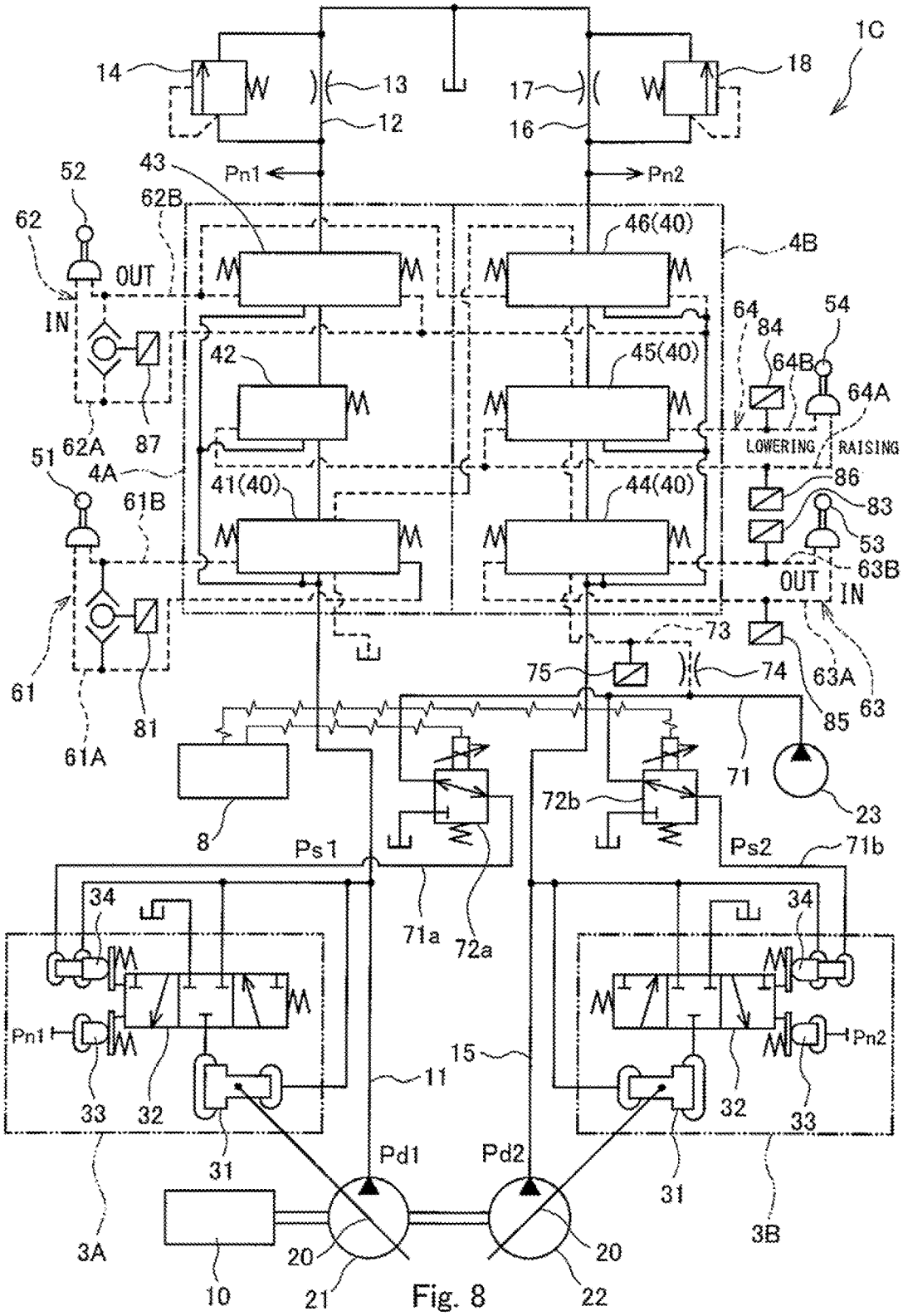
FIG. 8 shows an overall hydraulic circuit of a hydraulic drive system according to Embodiment 4 of the present invention.

Next, a hydraulic drive system 1C according to Embodiment 4 of the present invention is described with reference to FIG. 8. In the present embodiment, each of all the monitoring spools 40 has an ordinary structure as shown in FIG. 4 (i.e., a structure that blocks the spool movement detection line 73 when the spool has moved).

Further, in addition to the bucket-out pressure detector 83 and the boom-lowering pressure detector 84 described in Embodiment 3, the present embodiment includes a bucket-in pressure detector 85 provided on the bucket-in line 63A of the bucket pilot circuit 63, a boom-raising pressure detector 86 provided on the boom-raising line 64A of the boom pilot circuit 64, and an arm pressure detector 87 provided in the arm pilot circuit 62 (specifically, on the arm-in line 62A and the arm-out line 62B). The bucket-in pressure detector 85 is a detector for detecting that a pilot pressure has been generated in the bucket-in line 63A. The boom-raising pressure detector 86 is a detector for detecting that a pilot pressure has been generated in the boom-raising line 64A. The arm pressure detector 87 is a detector for detecting that a pilot pressure has been generated in the arm pilot circuit 62 (specifically, in the arm-in line 62A or the arm-out line 62B).

In the present embodiment, similar to Embodiment 3, not only a turning operation but also a bucket-out operation and a boom-lowering operation, for which a necessary flow rate is low, can be detected. Accordingly, the present embodiment can produce the same advantageous effects as those produced by Embodiment 3. In the present embodiment, the pilot circuits 61 to 64 of all the operating valves 51 to 54 are each provided with a pressure detector. Therefore, a turning operation being performed alone can be detected even by using the turning spool 41, the bucket spool 44, the boom spool 45, and the arm spool 46, each of which has an ordinary structure, as the monitoring spools 40. Consequently, a hydraulic drive system incorporated in an existing construction machine can be modified to be the hydraulic drive system of the present embodiment at low cost.

Moreover, since a bucket operation being performed alone can also be detected in the present embodiment, the second proportional valve 72*b* can also be controlled in such a manner as described at the end of Embodiment 1.

In the present embodiment, the arm spool 46 of the second multi-control valve 4B serves as a monitoring spool 40. However, of course, the arm spool 43 of the first multi-control valve 4A may serve as a monitoring spool 40 as described in Embodiment 1.

In a case where only a turning operation being performed alone and a turning operation and a boom-lowering operation being performed at the same time are intended to be detected, the bucket pilot circuit 63 may be provided with, in place of the bucket-out pressure detector 83 and the bucket-in pressure detector 85, a pressure detector (not shown) that is configured to selectively detect a higher one of the pilot pressures of the bucket-in line 63A and the bucket-out line 63B. Similarly, in a case where only a turning operation being performed alone and a turning operation and a bucket-out operation being performed at the same time are intended to be detected, the boom pilot circuit 64 may be provided with, in place of the boom-lowering pressure detector 84 and the boom-raising pressure detector 86, a pressure detector (not shown) that is configured to selectively detect a higher one of the pilot pressures of the boom-raising line 64A and the boom-lowering line 64B.

Other Embodiments

In the above-described Embodiments 1 to 4, the method of controlling the discharge flow rate of each of the first and second hydraulic pumps 21 and 22 need not be a negative control method, but may be a positive control method. That is, each of the first and second regulators 3A and 3B may include a positive control piston in place of the negative control piston 33. Alternatively, a method of controlling the discharge flow rate electrically (i.e., positive electrical control) may be adopted. Moreover, the method of controlling the discharge flow rate of each of the first and second hydraulic pumps 21 and 22 may be a load-sensing method.

INDUSTRIAL APPLICABILITY

The hydraulic drive system according to the present invention is useful for various construction machines.

REFERENCE SIGNS LIST

1A to 1C hydraulic drive system
21 first hydraulic pump
22 second hydraulic pump
24 turning hydraulic motor
3A first regulator
3B second regulator
4A first multi-control valve
4B second multi-control valve
40 monitoring spool
41 turning spool
44 bucket spool
42, 45 boom spool
61 to 64 pilot circuit
63B bucket-out line
64B boom-lowering line
72*a* first proportional valve
72*b* second proportional valve
73 spool movement detection line
75 monitoring pressure detector
8 controller
81 turning pressure detector
82 non-turning pressure detector
83 bucket-out pressure detector
84 boom-lowering pressure detector

The invention claimed is:

1. A hydraulic drive system of a construction machine including a turning hydraulic motor, the hydraulic drive system comprising:

a first hydraulic pump and a second hydraulic pump driven by an engine, each pump discharging hydraulic oil at a discharge flow rate corresponding to a tilting angle of the pump;

a first multi-control valve connected to the first hydraulic pump and including a turning spool for controlling the turning hydraulic motor;

a second multi-control valve connected to the second hydraulic pump;

a first regulator that adjusts the tilting angle of the first hydraulic pump in a manner to decrease the discharge flow rate of the first hydraulic pump in accordance with an increase in a discharge pressure of the first hydraulic pump and an increase in a first power shift pressure;

a first proportional valve that sets the first power shift pressure led to the first regulator;

a second regulator that adjusts the tilting angle of the second hydraulic pump in a manner to decrease the discharge flow rate of the second hydraulic pump in accordance with an increase in a discharge pressure of the second hydraulic pump and an increase in a second power shift pressure;

a second proportional valve that sets the second power shift pressure led to the second regulator;

a controller that controls the first proportional valve and the second proportional valve;

a spool movement detection line that extends through monitoring spools including the turning spool in a manner to extend over the first multi-control valve and the second multi-control valve;

a monitoring pressure detector for detecting that the spool movement detection line has been blocked; and a turning pressure detector for detecting that a pilot pressure has been generated in a pilot circuit that moves the turning spool, wherein:

the controller controls the first proportional valve in a manner to increase the first power shift pressure such that the discharge flow rate of the first hydraulic pump decreases either when the turning spool has moved alone or when the turning spool has moved and one or a plurality of cylinder spools included in the second multi-control valve have moved in such a direction that the hydraulic oil is supplied to a rod side, and the turning spool is configured not to block the spool movement detection line even when the turning spool has moved.

2. The hydraulic drive system according to claim 1, wherein the construction machine is a hydraulic excavator including a bucket, an arm, and a boom, the second multi-control valve includes a bucket spool and a boom spool, each of which serves as one of the monitoring spools, the bucket spool is configured not to block the spool movement detection line even when the bucket spool has moved in a bucket-out direction, the boom spool is configured not to block the spool movement detection line even when the boom spool has moved in a boom-lowering direction, and the hydraulic drive system further comprises:

a bucket-out pressure detector for detecting that a pilot pressure has been generated in a bucket-out line in a pilot circuit that moves the bucket spool; and a boom-lowering pressure detector for detecting that a pilot pressure has been generated in a boom-lowering line in a pilot circuit that moves the boom spool.

3. The hydraulic drive system according claim 2, wherein the construction machine is the hydraulic excavator including the bucket, the second multi-control valve includes the bucket spool, and the controller controls the second proportional valve in a manner to decrease the second power shift pressure such that the discharge flow rate of the second hydraulic pump increases when the bucket spool has moved alone.

4. The hydraulic drive system according to claim 1, wherein the construction machine is a hydraulic excavator including a bucket, the second multi-control valve includes a bucket spool, and the controller controls the second proportional valve in a manner to decrease the second power shift pressure such that the discharge flow rate of the second hydraulic pump increases when the bucket spool has moved alone.

5. A hydraulic drive system of a construction machine including a turning hydraulic motor, the hydraulic drive system comprising:

a first hydraulic pump and a second hydraulic pump driven by an engine, each pump discharging hydraulic oil at a discharge flow rate corresponding to a tilting angle of the pump;

a first multi-control valve connected to the first hydraulic pump and including a turning spool for controlling the turning hydraulic motor;

a second multi-control valve connected to the second hydraulic pump;

a first regulator that adjusts the tilting angle of the first hydraulic pump in a manner to decrease the discharge flow rate of the first hydraulic pump in accordance with an increase in a discharge pressure of the first hydraulic pump and an increase in a first power shift pressure;

a first proportional valve that sets the first power shift pressure led to the first regulator;

a second regulator that adjusts the tilting angle of the second hydraulic pump in a manner to decrease the discharge flow rate of the second hydraulic pump in accordance with an increase in a discharge pressure of the second hydraulic pump and an increase in a second power shift pressure;

a second proportional valve that sets the second power shift pressure led to the second regulator;

a controller that controls the first proportional valve and the second proportional valve;

a spool movement detection line that extends through monitoring spools including the turning spool in a manner to extend over the first multi-control valve and the second multi-control valve;

a turning pressure detector for detecting that a pilot pressure has been generated in a pilot circuit that moves the turning spool; and a non-turning pressure detector for detecting that a pilot pressure has been generated in any of pilot circuits that move the monitoring spools except the turning spool, wherein:

the controller controls the first proportional valve in a manner to increase the first power shift pressure such that the discharge flow rate of the first hydraulic pump decreases either when the turning spool has moved alone or when the turning spool has moved and one or a plurality of cylinder spools included in the second multi-control valve have moved in such a direction that the hydraulic oil is supplied to a rod side, and the turning spool is configured to block the spool movement detection line when the turning spool has moved.

6. The hydraulic drive system according to claim 5, wherein the construction machine is a hydraulic excavator including a bucket, an arm, and a boom, the second multi-control valve includes a bucket spool and a boom spool, each of which serves as one of the monitoring spools, the bucket spool is configured not to block the spool movement detection line even when the bucket spool has moved in a bucket-out direction, the boom spool is configured not to block the spool movement detection line even when the boom spool has moved in a boom-lowering direction, and the hydraulic drive system further comprises:

a bucket-out pressure detector for detecting that a pilot pressure has been generated in a bucket-out line in a pilot circuit that moves the bucket spool; and a boom-lowering pressure detector for detecting that a pilot pressure has been generated in a boom-lowering line in a pilot circuit that moves the boom spool.

7. The hydraulic drive system according claim 6, wherein the construction machine is the hydraulic excavator including the bucket, the second multi-control valve includes the bucket spool, and the controller controls the second proportional valve in a manner to decrease the second power shift pressure such that the discharge flow rate of the second hydraulic pump increases when the bucket spool has moved alone.

8. The hydraulic drive system according claim 5, wherein the construction machine is a hydraulic excavator including a bucket, the second multi-control valve includes a bucket spool, and the controller controls the second proportional valve in a manner to decrease the second power shift pressure such that the discharge flow rate of the second hydraulic pump increases when the bucket spool has moved alone.

9. A hydraulic drive system of a construction machine including a turning hydraulic motor, the hydraulic drive system comprising:

a first hydraulic pump and a second hydraulic pump driven by an engine, each pump discharging hydraulic oil at a discharge flow rate corresponding to a tilting angle of the pump;

a first multi-control valve connected to the first hydraulic pump and including a turning spool for controlling the turning hydraulic motor;

a second multi-control valve connected to the second hydraulic pump;

a first regulator that adjusts the tilting angle of the first hydraulic pump in a manner to decrease the discharge flow rate of the first hydraulic pump in accordance with an increase in a discharge pressure of the first hydraulic pump and an increase in a first power shift pressure;

a first proportional valve that sets the first power shift pressure led to the first regulator;

a second regulator that adjusts the tilting angle of the second hydraulic pump in a manner to decrease the discharge flow rate of the second hydraulic pump in accordance with an increase in a discharge pressure of the second hydraulic pump and an increase in a second power shift pressure; and a second proportional valve that sets the second power shift pressure led to the second regulator, wherein:

the construction machine is a hydraulic excavator including a bucket, an arm, and a boom, the hydraulic drive system further comprises a spool movement detection line that extends though monitoring spools including the turning spool in a manner to extend over the first multi-control valve and the second multi-control valve, the first multi-control valve or the second multi-control valve includes an arm spool that serves as one of the monitoring spools, the second multi-control valve includes a bucket spool and a boom spool, each of which serves as one of the monitoring spools, each of the turning spool, the arm spool, the bucket spool, and the boom spool is configured to block the spool movement detection line when having moved, and each of pilot circuits that move the turning spool, the arm spool, the bucket spool, and the boom spool, respectively, is provided with a pressure detector for detecting that a pilot pressure has been generated in the pilot circuit.

* * * * *